US010321726B2

(12) United States Patent
Horvath

(10) Patent No.: US 10,321,726 B2
(45) Date of Patent: Jun. 18, 2019

(54) CUSTOMIZABLE NECKTIE

(71) Applicant: Richard Horvath, San Diego, CA (US)

(72) Inventor: Richard Horvath, San Diego, CA (US)

( * ) Notice: Subject to any disclaimer, the term of this patent is extended or adjusted under 35 U.S.C. 154(b) by 0 days.

(21) Appl. No.: 15/880,343

(22) Filed: Jan. 25, 2018

(65) Prior Publication Data

US 2018/0206565 A1 Jul. 26, 2018

Related U.S. Application Data

(60) Provisional application No. 62/450,995, filed on Jan. 26, 2017.

(51) Int. Cl.

*A41D 25/00* (2006.01)
*A41D 25/02* (2006.01)
*A41D 25/04* (2006.01)

(52) U.S. Cl.

CPC ..... *A41D 25/005* (2013.01); *A41D 25/027* (2013.01); *A41D 25/04* (2013.01); *A41D 2300/32* (2013.01); *A41D 2300/324* (2013.01); *A41D 2300/326* (2013.01); *A44D 2203/00* (2013.01)

(58) Field of Classification Search

CPC ..... A41D 25/005; A41D 27/027; A41D 25/04
USPC ..... 2/149
See application file for complete search history.

(56) References Cited

U.S. PATENT DOCUMENTS 5,035,002 A * 7/1991 Knight, Jr. ..... A41D 25/022 2/137
5,774,893 A * 7/1998 Torres ..... A41D 25/025 2/148
2001/0042259 A1* 11/2001 Paik ..... A41D 25/02 2/149
2011/0219516 A1* 9/2011 Pionessa ..... A41D 25/027 2/145

* cited by examiner

*Primary Examiner* — Alissa J Tompkins
*Assistant Examiner* — Catherine M Ferreira
(74) *Attorney, Agent, or Firm* — Knobbe Martens Olson & Bear LLP

(57) ABSTRACT

A necktie is disclosed. The necktie includes a knot portion that can be secured at or around a neck of a wearer. The knot portion includes a simulated knot having a front loop and a first attachment mechanism positioned on the simulated knot and covered by the front loop. The first attachment mechanism is accessible via an opening. The necktie also includes a blade portion. The blade portion includes a second attachment mechanism that can releasably attach to the first attachment mechanism.

10 Claims, 6 Drawing Sheets

CUSTOMIZABLE NECKTIE

BACKGROUND

Field

This disclosure relates to neckwear. In particular, customizable neckties and systems that include a knot portion configured to be secured at or around a wearer's neck and a removably attachable blade portion are disclosed.

Description

A necktie is a long strip of cloth or other material that is frequently worn around the neck. Neckties are commonly considered a staple of men's business or formal attire but can also be worn by women. Commonly, a necktie is worn under a shirt collar and knotted at the throat, with the tie knot resting between the collar points. Neckties are available in a wide range of colors, patterns, shapes, and styles.

SUMMARY

The embodiments disclosed herein have several aspects no single one of which is solely responsible for the disclosure's desirable attributes. Without limiting the scope of this disclosure, its more prominent features will now be briefly discussed. After considering this discussion, and particularly after reading the section entitled "Detailed Description," one will understand how the features of the embodiments described herein provide advantages over existing neckties.

In a first aspect, a necktie is disclosed. The necktie includes a knot portion configured to be secured at or around a neck of a wearer. The knot portion includes a simulated knot having a front loop, and a first attachment mechanism positioned on the simulated knot and covered by the front loop. The first attachment mechanism is accessible via an opening. The necktie also includes a blade portion having a second attachment mechanism configured to releasably attach to the first attachment mechanism. The second attachment mechanism is positioned on the blade portion proximal to a top end of the blade portion.

In some embodiments, the knot portion further comprises a first strap extending from a first side of the simulated knot, a third attachment mechanism positioned on a distal end of the first strap, a second strap extending from a second side of the simulated knot, and a fourth attachment mechanism positioned on a distal end of the second strap. In some embodiments, the third attachment mechanism is configured to releasably attach to the fourth attachment mechanism to secure the knot portion around the wearer's neck. In some embodiments, the knot portion further comprises a continuous band configured to secure the knot portion around the wearer's neck. In some embodiments, the continuous band includes an elastic portion. In some embodiments, the knot portion further comprises a clip configured to secure the knot portion to a collar of a shirt. In some embodiments, the blade portion comprises a front blade portion and a rear blade portion. In some embodiments, the blade portion is reversible. In some embodiments, the second attachment mechanism of the blade portion comprises an attachment mechanism on a first side of the blade portion and an attachment mechanism on a second side of the blade portion. In some embodiments, the first and second attachment mechanisms comprise hook and loop material. In some embodiments, the first and second attachment mechanisms comprise snaps. In some embodiments, the first and second attachment mechanisms comprise a hook-and-eye closure mechanism. In some embodiments, the first and second attachment mechanisms comprise a magnetic closure mechanism.

In another aspect, a customizable necktie system is disclosed. The system includes at least one knot portion including a simulated knot and a first attachment mechanism. The system also includes a plurality of blade portions, each including a second attachment mechanism configured to releasably attach to the first attachment mechanism of the at least one knot portion.

In some embodiments, the second attachment mechanism of any of the plurality of blade portions is configured to releasably attach to the first attachment mechanism of the knot portion. In some embodiments, the at least one knot portion comprises a plurality of knot portions, each of the plurality of knot portion including the first attachment mechanism. In some embodiments, at least one of the plurality of knot portions comprises a simulated knot of a first type that is different than at least one of the other of the plurality of knot portions. In some embodiments, the second attachment mechanism of any of the plurality of blade portions can releasably attach to the first attachment mechanism of any of the plurality of knot portions. In some embodiments, at least one of the plurality of blade portions is reversible. In some embodiments, the first and second attachment mechanisms comprise hook and loop material, snaps, or a hook-and-eye closure mechanism.

In another aspect, a necktie includes a knot portion including a simulated knot and a means for securing the knot portion at or around a neck of a wearer, a blade portion, and a means for releasably attaching the blade portion to the knot portion. In some embodiments, the means for securing the knot portion at or around a neck of the wearer is selected from the group consisting of a first strap and a second strap, a continuous elastic band, a continuous band comprising an elastic portion, and a clip. In some embodiments, the means for releasably attaching the blade portion to the knot portion is selected from the group consisting of hook and loop material, a snap, a button and a button hole, a hook-and-eye closure, a magnetic fastener, a pin, and a tack.

In another aspect, a kit is disclosed. The kit includes at least one knot portion including a simulated knot and a first attachment mechanism. The kit also includes at least one blade portion, the at least one blade portion including a second attachment mechanism configured to releasably attach to the first attachment mechanism of the at least one knot portion.

In some embodiments, the at least one knot portion comprises a plurality of knot portions. In some embodiments, the at least one blade portion comprises a plurality of blade portions. In some embodiments, the second attachment mechanism of any of the at least one blade portions is configured to releasably attach to the first attachment mechanism of any of the at least one knot portions. In some embodiments, at least one of the plurality of knot portions comprises a simulated knot of a first type that is different than at least one of the other of the plurality of knot portions. In some embodiments, the second attachment mechanism of any of the plurality of blade portions can releasably attach to the first attachment mechanism of any of the plurality of knot portions. In some embodiments, at least one of the plurality of blade portions is reversible. In some embodiments, the first and second attachment mechanisms comprise hook and loop material, snaps, or a hook-and-eye closure mechanism.

BRIEF DESCRIPTION OF THE DRAWINGS

The foregoing and other features of the disclosure will become more fully apparent from the following description and appended claims, taken in conjunction with the accompanying drawings. The drawings may not be to scale.

DETAILED DESCRIPTION

Figure 1A:
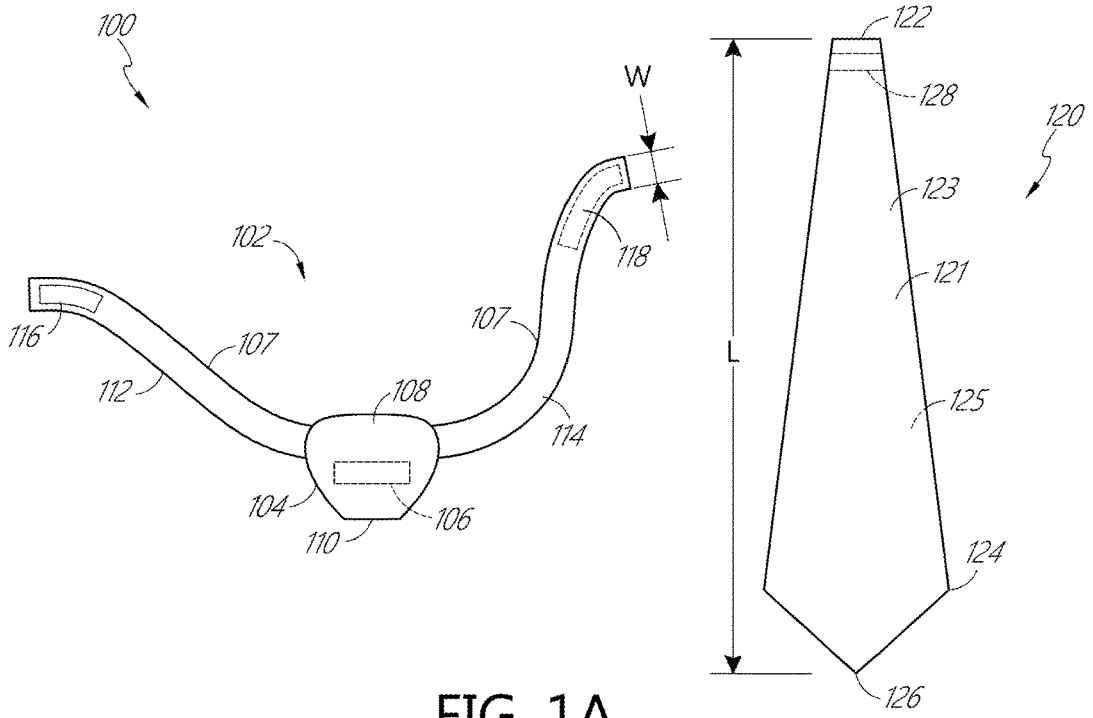
FIG. 1A illustrates a knot portion and a blade portion of an embodiment of a customizable necktie in an unattached configuration.

This disclosure relates to neckties, and in particular, to customizable neckties and systems. In some embodiments, a customizable necktie includes a knot portion. The knot portion can be configured to secured around a wearer's neck or to a wearer's shirt or collar and can include a knot. In some embodiments, the knot is a simulated or preformed knot that has the appearance of any knot that is used to tie a necktie (for example, a Windsor knot, a half-Windsor knot, a four-in-hand knot, a Pratt knot, bolo etc.). In some embodiments, the knot portion comprises an insert covered in fabric. The customizable necktie can also include a blade portion that is removably attachable to the knot portion. When attached to the knot portion, the blade portion hangs down from the knot portion and has an appearance that is similar or identical to a traditional necktie.

In some embodiments, a customizable necktie system can include at least one knot portion and a plurality of different blade portions. Each of the plurality of different blade portions can have a different color, pattern, style, and/or shape. To create a customizable necktie, a wearer can select and attach any of the plurality of different blade portions to the knot portion. The style and appearance of the customizable necktie can be varied by selecting and attaching different blade portions to the knot portion. In some embodiments, a customizable necktie system also includes a plurality of knot portions of different colors, patterns, styles, etc.

The customizable neckties and systems described herein can provide one or more advantages over traditional neckties. For example, in some embodiments, a customizable necktie does not require the wearer to tie the necktie. Instead, the wearer can simply attach (as will be more fully described below) a blade portion to a knot portion that includes a simulated or preformed knot. This can be advantageous as many wearers may find executing the knots traditionally used to tie neckties to be difficult. As another example, in some embodiments, the customizable neckties described herein allow a user to vary the style and appearance of the customizable necktie by combining different blade portions with different knot portions. In some embodiments, for example, a customizable necktie allows a user to pair a blade portion of a first color with a knot portion of a second color to create a necktie that has a knot that is a different color than the blade—such an appearance is not readily achievable with traditional neckties.

In the following detailed description, reference is made to the accompanying drawings. In the drawings, similar symbols typically identify similar components, unless context dictates otherwise. Thus, in some embodiments, part numbers can be used for similar components in multiple figures, or part numbers can vary from figure to figure. The illustrative embodiments described herein are not meant to be limiting. Other embodiments can be utilized, and other changes can be made, without departing from the spirit or scope of the subject matter presented. It will be readily understood that the aspects of the present disclosure and illustrated in the figures, can be arranged, substituted, combined, and designed in a wide variety of different configurations by a person of ordinary skill in the art, all of which are made part of this disclosure.

FIG. 1A illustrates a knot portion 102 and a blade portion 120 of an embodiment of a customizable necktie 100. The knot portion 102 is configured to be secured around a wearer's neck and includes a knot 104. The blade portion 120 is configured in size and shape to correspond to the portion of a conventional necktie that hangs below the knot. In FIG. 1A, the knot portion 102 and the blade portion 120 are illustrated in an unattached configuration; however, the blade portion 120 can be releasably attached to the knot portion 102 as shown in the attached configuration of FIG. 1B. In some embodiments, in the attached configuration, the necktie 100 has an appearance that is similar or identical to a conventional necktie. That is, in some embodiments, when the necktie 100 is worn by a wearer, it may not be readily apparent to an observer that the necktie 100 is not a conventional necktie.

With reference to FIG. 1A, the knot portion 102 includes a knot 104 as noted above. In some embodiments, the knot 104 is a simulated or preformed knot. That is, the knot 104 can be configured with the shape of a knot, but need not be actually tied by a wearer. The knot 104 can have the appearance of any knot that is used to tie a conventional necktie, such as a Windsor knot, a half-Windsor knot, a four-in-hand knot, a Pratt knot, etc. In some embodiments, the knot 104 is made from materials that are commonly used in conventional neckties, including, but not limited to, a silk or polyester shell surrounding an interlining material made of brushed wool or other similar materials. In some embodiments, the knot 104 can be formed by first tying a length of fabric into a knot shape and then sewing the fabric together such that the knot cannot be undone. In some embodiments, the knot 104 can comprise fabric covered insert has the shape of a knot. For example, an insert can be formed that has the general shape of a knot and covered with fabric so as to have the appearance of a knot. The insert can be made from, for example, plastic, metal, wood, rubber, foam, a padding material, a batting material, etc.

The knot 104 includes an attachment mechanism 106. The attachment mechanism 106 is configured to allow the blade portion 120 to attach to the knot 104. In some embodiments, the attachment mechanism 106 of the knot 104 attaches to a corresponding attachment mechanism 128 on the blade portion 120. In some embodiments, the attachment mechanism 106 of the knot 104 is not externally visible. For example, in the illustrated embodiment, the attachment mechanism 106 is hidden below (and is thus illustrated with dashed lines) a front loop 108 of the knot 104. The front loop 108 of the knot 104 is shown in greater detail in FIGS. 2A and 2B. In the illustrated embodiment, the attachment mechanism 106 is accessible via an opening 110. The opening 110 can be formed in the bottom of the knot 104. The opening 110 is shown in greater detail in FIG. 2C. In some embodiments, the attachment mechanism 106 is positioned on the back of the knot 104 such that it is not visible when the necktie 100 is worn.

The blade portion 120 includes an attachment mechanism 128. The attachment mechanism 128 of the blade portion 120 is configured to releasably attach to the attachment mechanism 106 of the knot portion 102. In the illustrated embodiment of FIG. 1A, the attachment mechanism 128 is positioned on a back side 125 of the blade portion 120 and thus is illustrated with dashed lines. In the illustrated embodiment, the attachment mechanism 128 is positioned proximal to a top end 122 of the blade portion 120. For example, in some embodiments, the attachment mechanism 128 is positioned within 2 inches, within 1.75 inches, within 1.5 inches, within 1.25 inches, within 1.0 inches, within 0.75 inches, 0.5 inches, or within 0.25 inches of the top 122 of the blade portion 120.

As noted previously, the attachment mechanism 128 of the blade portion 120 is configured to correspond with and releasably attach to the attachment mechanism 106 of the knot portion 102. For example, the attachment mechanisms 106, 128 can comprise hook and loop material (e.g., Velcro), snaps, buttons and button holes, hook-and-eye closures, magnetic fasteners, pins, tacks, or any other suitable type of attachment mechanism. In some embodiments, the attachment mechanisms 106, 128 are not externally visible or apparent when the necktie 100 is worn. In some embodiments, the attachment mechanisms 106, 128 are visible.

In some embodiments, the attachment mechanism 128 of the blade portion 120 is releasably attached to the attachment mechanism 106 of the knot portion 102 by inserting the top end 122 of the blade portion 120 through the opening 110 in the knot 104 and underneath the front loop 108 of the knot 104 until the attachment mechanism 128 reaches the attachment mechanism 106.

In some embodiments, the attachment mechanisms 106, 128 comprise a tie tack that is inserted through both the knot 104 and the blade portion 128 to attach the blade portion 128 to the knot portion 102. For example, the top end 122 of the blade portion 120 can be inserted through the opening 110 below the front flap 108. A tie tack can be pushed through the front flap 108 and the top end 122 of the blade portion 120 to releasably attach the blade portion 120 to the knot portion 102.

Figure 1B:
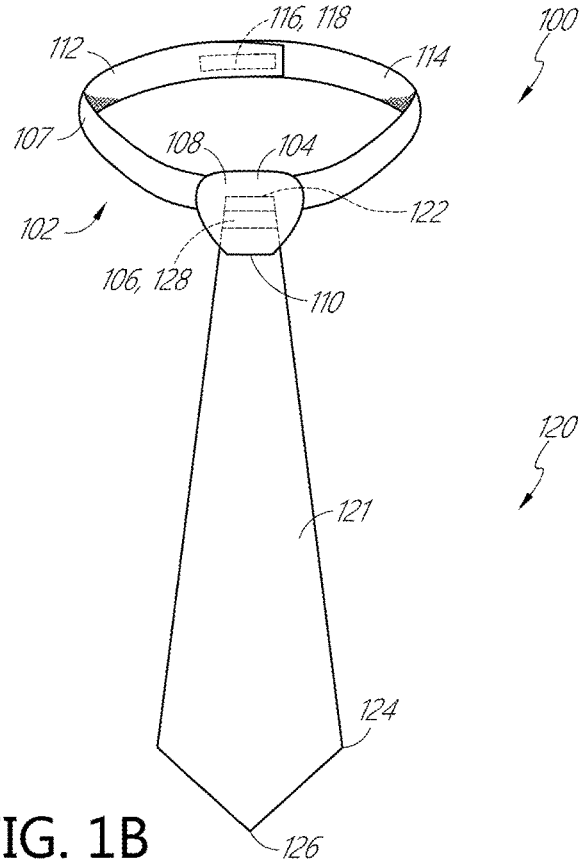
FIG. 1B illustrates the knot portion and the blade portion of the customizable necktie of FIG. 1A in an attached configuration.

With continued reference to the illustrated embodiment of FIGS. 1A and 1B, the knot portion 102 includes a neck portion 107 that extends from the knot 104. The neck portion 107 is configured to secure the knot portion 102 around a user's neck. As illustrated, the neck portion 107 includes a first strap 112 and second strap 114. The first strap 112 extends from a first side of the knot 104 and the second strap 114 extends from a second side of the knot 104. An attachment mechanism 116 is positioned proximal to the end of the first strap 112 and corresponding attachment mechanism 118 is positioned proximal to the end of the second strap 114. The attachment mechanism 116 is configured to attach to the attachment mechanism 118 to releasably attach the first strap 112 to the second strap 114 as shown in FIG. 1B. The attachment mechanisms 116, 118 can comprise, for example, hook and loop material (e.g. Velcro), snaps, buttons and button holes, hook-and-eye closures, magnetic fasteners, buckles (e.g., similar to a belt), pins, tacks, or any other suitable type of attachment mechanism.

Figure 5:
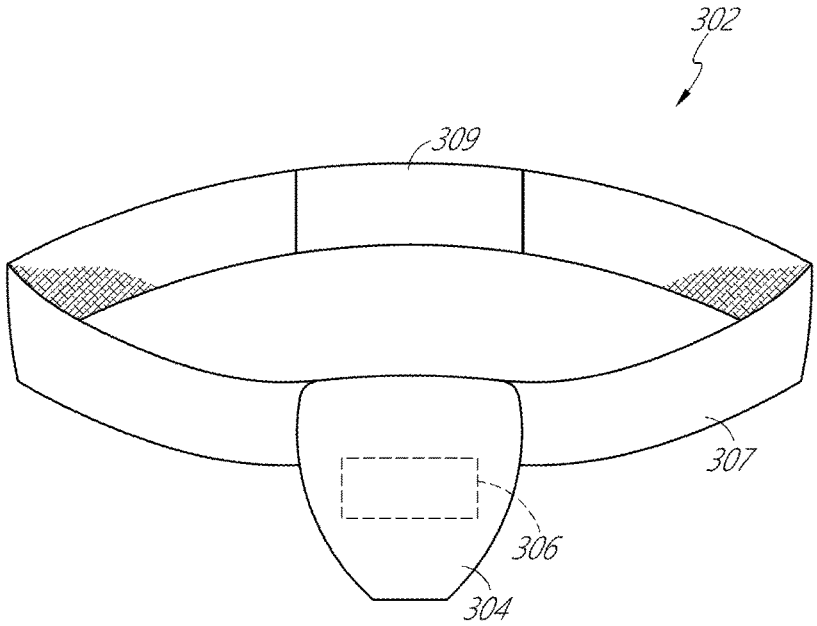
FIG. 5 is an embodiment of a knot portion for a customizable necktie.
Figure 6A:
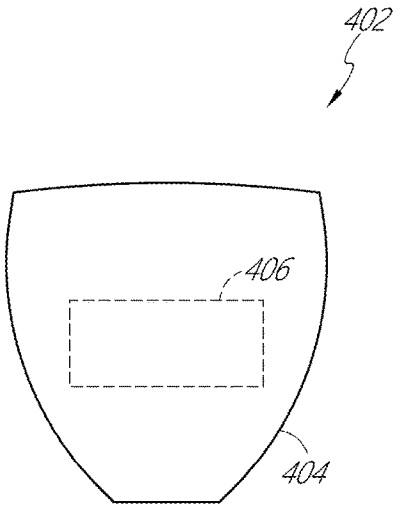
FIG. 6A is a front view an embodiment of a clip-on knot portion for a customizable necktie.
Figure 6B:
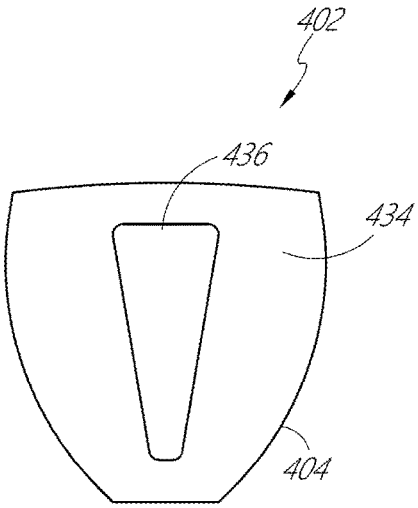
FIG. 6B is a back view of the clip-on knot portion of FIG. 6A.

In some embodiments, the first and second straps 112, 114 are configured to accommodate (in other words, fit) a range of neck sizes. For example, the attachment mechanism 118 can attach to the attachment mechanism 116 at a first location such that the neck portion 107 forms a first circumference, and the attachment mechanism 118 can attach to the attachment mechanism 116 at a second location such that the neck portion 107 forms a second circumference. In some embodiments, the neck portion 107 can be configured to accommodate necks between 8 and 20 inches, between 10 and 19 inches, between 12 and 18 inches, and between 14 and 18 inches, although other ranges are also possible. In some embodiments, the first and second straps 112, 114 are the same length. In some embodiments, the first strap 112 is longer than the second strap 114 or vice versa. In some embodiments, the neck portion 107 comprises a continuous loop as shown in FIG. 5. In some embodiments, the neck portion 107 is omitted and the knot portion 102 includes a clip that is used to attach the knot portion 102 to a shirt as shown in FIGS. 6A and 6B.

With continued reference to FIGS. 1A and 1B, the first and second straps 112, 114 of the neck portion 107 can be configured to fit under a shirt collar in a manner similar to a convention necktie, such that the knot 104 is positioned on a wearer's throat generally between the points of the shirt collar. As such, in some embodiments, the first and second straps 112, 114 are configured in size and shape to have a width W that can be hidden under a shirt collar. For example, in some embodiments, the first and second straps 112, 114 can have a width W of approximately no more than 1.5 inches, no more than 1.25 inches, no more than 1.0 inches, no more than 0.75 inches, no more than 0.25 inches, or thinner, although other widths are also possible. In some embodiments, the first and second straps 112, 114 can have a thickness that is comparable to the thickness of a conventional necktie or thinner.

In some embodiments, the first and second straps 112, 114 of the neck portion 107 extend from the knot 104 with an appearance that is similar or identical to a conventional necktie when worn. In some embodiments, the neck portion 107, including the first and second straps 112, 114, is made from materials that are commonly used in conventional neckties, including, but not limited to, a silk or polyester shell surrounding an interlining material of brushed wool or other similar materials.

In the illustrated embodiment of FIG. 1A, the blade portion 120 has the appearance of the visible portion of the blade of a conventional necktie. As shown, the blade portion extends between top end 122 and tip 126. A length L, measured between the top end 122 and the tip 126, can be configured to correspond to the length of the visible portion of the blade of a conventional necktie (as measured between the knot and the tip of the conventional necktie). For example, in some embodiments, the length L can be between 15 inches and 25 inches long, although other lengths are possible. For example, the length L can be 2 inches, 4 inches, 6 inches, 8 inches, 10 inches, 12, inches 14 inches, 16 inches, 18 inches, 20 inches, 22 inches, 24 inches, 26 inches, 28 inches, 30 inches, as well as any value or range therebetween. In some embodiments, the length L is longer than 30 inches. In some embodiments, the length L is chosen to correspond to the particular wearer such that when the necktie 100 is worn, the tip 126 of the blade portion 120 falls approximately at the wearer's belt buckle, although the length L can be longer or shorter depending on the wearer's preference.

The blade portion 120 includes a front blade 121 which corresponds to the front blade, wide blade, or visual portion below the knot of a conventional necktie. In some embodiments, the blade portion 120 may also include a rear blade 134 (see FIG. 3B) that corresponds to the back blade or narrow blade of a conventional necktie. In the illustrated embodiment of FIGS. 1A and 1B, the front blade 121 tapers outwardly from the top end 122 to a wide point 124 before tapering inwardly to the tip 126. The angle of these tapers can be varied without limit depending on style. For example, the front blade 121 can have a shape that mimics a conventional tie, a wide/fat tie, a narrow/skinny tie, or any other type of tie without limit. In some embodiments, the blade portion 120 is made from materials that are commonly used in conventional neckties, including, but not limited to, a silk or polyester shell surrounding an interlining material of brushed wool or other similar materials.

When worn, a front surface 123 of the front blade 121 is visible and a back surface 125 of the front blade 121 is positioned against a wearer's body. In some embodiments, the attachment mechanism 128 is positioned on the back surface 125 of the blade portion 121. In some embodiments, the attachment mechanism 128 is configured on the front surface 123 of the front blade 121. In some embodiments, the rear blade 134 is omitted.

FIG. 1B illustrates the knot portion 102 and the blade portion 120 of the necktie 100 in an attached configuration. As shown, the top end 122 of the blade portion 120 is positioned below the front flap 108 of the knot 104 (by inserting the top end 122 through the opening 110) such that the attachment mechanism 128 of the blade portion 120 releasably attaches to the attachment mechanism 106 of the knot portion 102. Although the connection between the blade portion 120 and the knot portion 102 is illustrated using dashed lines in FIG. 1B, in some embodiments, this connection is not readily apparent to an observer, such that the necktie 100 appears to be a conventional necktie. In FIG. 1B, the first strap 112 is illustrated attached to the second strap 114 (attachment mechanism 116 is attached to attachment mechanism 118) as if the knot portion 102 were secured around a wearer's neck.

Although FIGS. 1A and 1B illustrate only one knot portion 102 and one blade portion 120, a system for customizable ties may include more than one of either, such that knot portions 102 can be mixed and matched with blade portions 122 to create various combinations and styles. For example, a plurality of knot portions 102 can be provided in various colors and patterns, and with different sizes and types of knots. Similarly, a plurality of blade portions 122 can be provided in various colors, patterns, lengths, shapes, etc. In some embodiments, any of the plurality of blade portions 122 can be attached to any of the plurality of knot portions 102. A particular advantage of some embodiments of customizable tie systems is that a wearer can create a tie with a knot of a first color or pattern and a blade of a second color or pattern to create a look that is not readily achievable with a conventional necktie.

Figure 2A:
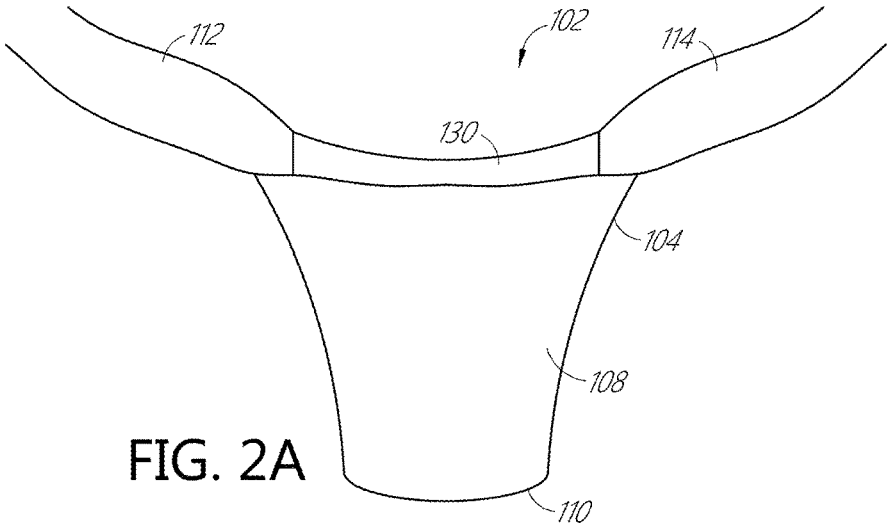
FIG. 2A is a front detail view of an embodiment of a knot portion for a customizable necktie.
Figure 2B:
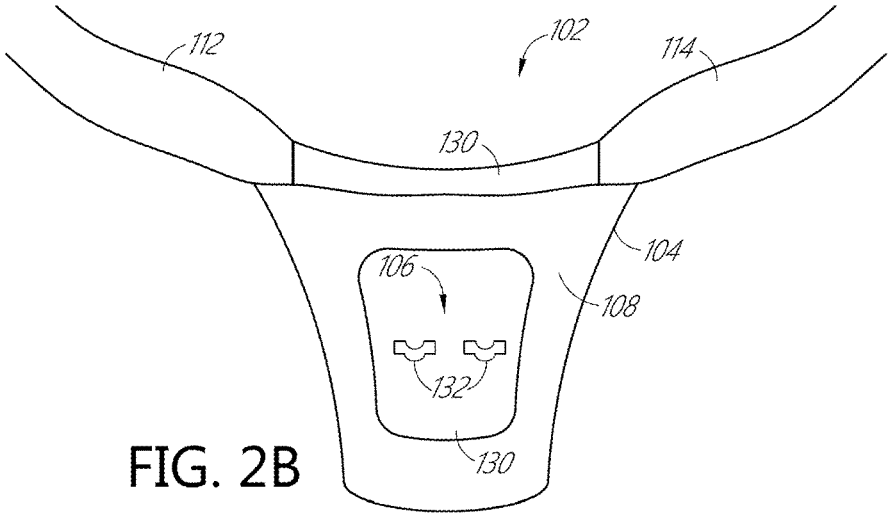
FIG. 2B is a cutaway front detail view of the knot portion of FIG. 2A, which illustrates an embodiment of an attachment mechanism on the knot portion for attaching the blade portion to the knot portion.
Figure 2C:
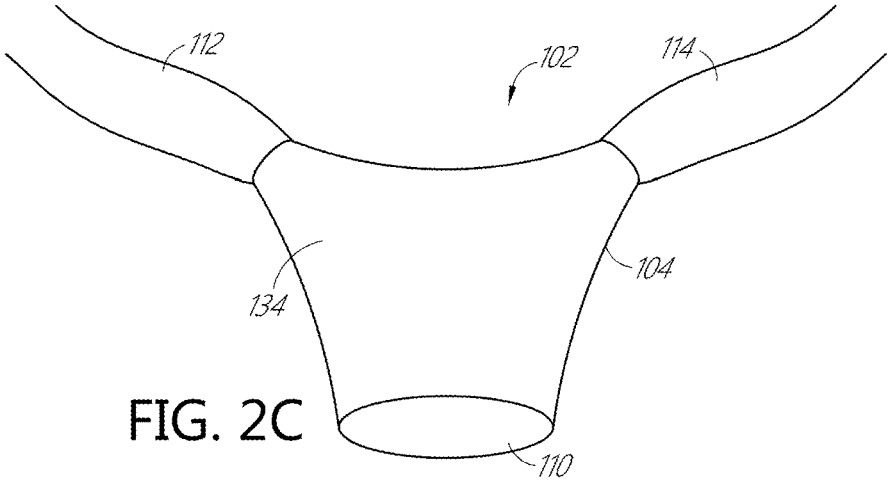
FIG. 2C is a back detail view of the knot portion of FIG. 2A.

FIG. 2A is a front detail view of an embodiment of a knot portion 102. As shown, the front loop 108 wraps over an inner surface 130 of the knot 104. A portion of the inner surface 130 may be visible between first and second straps 112, 114. In some embodiments, the front loop 108 comprises a strip of material that extends transversely across the knot 104 (for example, from the right of the knot 104 to the left of the knot 104 relative to the orientation shown in FIG. 2A). FIG. 2B is a cutaway front detail view of the knot portion 102 of FIG. 2A. In FIG. 2B, a portion of the front loop 108 has been cutaway to illustrate an example position of the attachment mechanism 106. In the illustrated embodiment, the attachment mechanism 106 comprises two eyes 132 (for example, eyes of a hook-and-eye type closure) attached to the inner surface 130 below the front loop 108. Other numbers of eyes 132, such as one, two, three, four, or more, may also be used. FIG. 2C is a back detail view of the knot portion 102 of FIG. 2A. The opening 110 is shown in FIG. 2C. The opening 110 can be formed by the space between the front loop 108 and the inner surface 130. The opening 110 can be configured to allow access below the front loop 108 to the attachment mechanism 106 (e.g., the eyes 132) positioned on the inner surface 130 of the knot. Other configurations for the knot portion 102, as well as other placements of the attachment mechanism 106 are possible. In some embodiments, the attachment mechanism 106 can be placed on an interior surface of the inner loop 108.

Figure 3A:
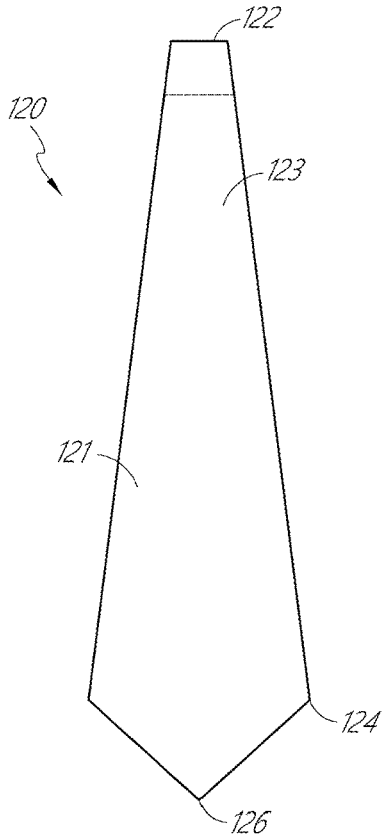
FIG. 3A is a front view of an embodiment of a blade portion for a customizable necktie.
Figure 3B:
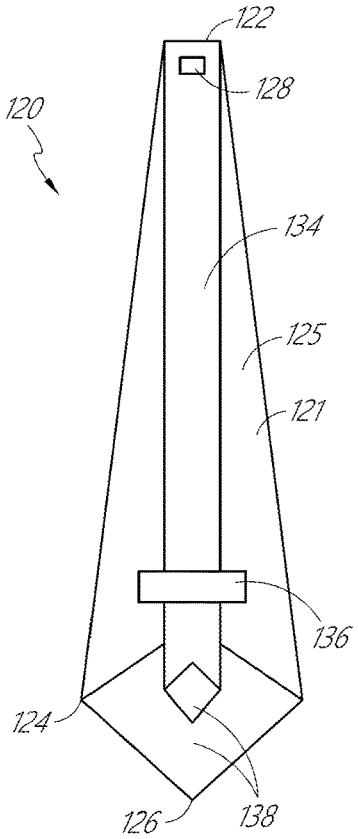
FIG. 3B is a back view of the blade portion of FIG. 3A.

FIGS. 3A and 3B are front and back views of an embodiment of a blade portion 120. FIG. 3A shows the front side 123 of the front blade 121 which extends from the top end 122 to the wide point 124 to the tip 126 as previously described with reference to FIGS. 1A and 1B. As shown in the back view FIG. 3B, the underside of the blade portion 120 can have an appearance which mimics a conventional necktie. For example, an underside of the blade portion 120 can include a back blade 134. The back blade 134 can be attached to the top blade 121 at the top end 122. A keeper loop 136 can be attached to the back side 125 of the front blade 121 and configured to help hide the back blade 134 below the front blade 121. Tipping material 138 can be included at the tips of the back sides of the back blade 134 and the front blade 121 to mimic the appearance of a conventional necktie. In some embodiments, the attachment mechanism 128 is positioned on the back blade 134 proximal to the top end 122.

Figure 3C:
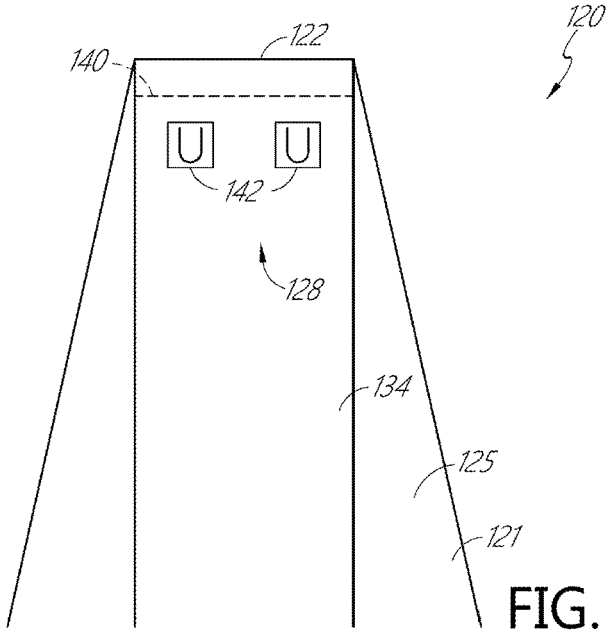
FIG. 3C is a detail view of an embodiment an attachment mechanism on the blade portion for attaching the blade portion to the knot portion.

FIG. 3C is a detail view of an embodiment an attachment mechanism 128 on the blade portion 120 of FIG. 3B. In the illustrated embodiment, the attachment mechanism 128 includes two hooks 142 (for example, hooks of a hook-and-eye type closure) for attaching the blade portion 120 to the knot portion 102. Other numbers of hooks 142, for example, one, two, three, four, or more are possible. In some embodiments, the two hooks 142 are positioned to attach to the two eyes 132 shown in FIG. 2B. FIG. 3C also illustrates an example stitch 140 that secures the front blade 121 to the back blade 134. In some embodiments, the front blade 121 and the back blade 134 are continuous and the stitch 140 defines a fold between the front blade 121 and the back blade 134. In some embodiments, the stitch line 140 is proximal to the top end 122, for example, within 1.0 inches, within 0.5 inches, within 0.25 inches, or within 0.125 inches, although other placements of the stitch line 140 are possible. In some embodiments, the stitch 140 is not visible when the blade portion 120 is attached to the knot portion 102. In some embodiments, the stitch 140 is above (i.e., nearer the top end 122 than) the attachment mechanism 128. In some embodiments, the stitch 140 is below (i.e., further from the top end 122 than) the attachment mechanism 128. In some embodiments, multiple stitches 140 are included. In some embodiments, the stitch 140 is omitted.

Figure 4A:
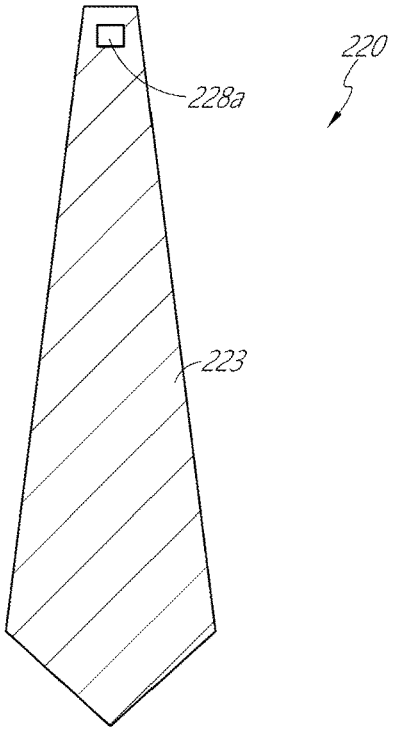
FIG. 4A is a front view of an embodiment of a reversible blade portion for a customizable necktie.
Figure 4B:
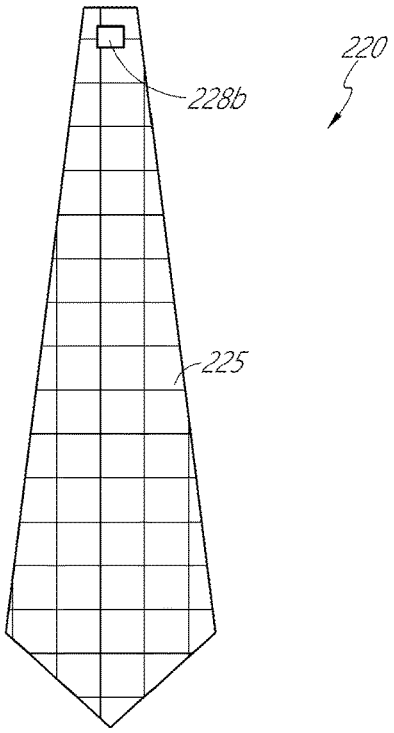
FIG. 4B is a back view of the reversible blade portion of FIG. 4A.

FIGS. 4A and 4B are front and back views of an embodiment of a reversible blade portion 220 for a customizable necktie 100. The reversible blade portion 220 includes a front side 223 (FIG. 4A) and a back side 225 (FIG. 4B). The front side 223 includes an attachment mechanism 228*a* and the back side 225 includes an attachment mechanism 228*b*. Because the reversible blade portion 220 includes attachment mechanisms 228*a*, 228*b* on each side 223, 225 it can be attached to a knot portion 102 with either the front side 223 or the back side 225 exposed. In some embodiments, the front side 221 includes first color or pattern and the back side 223 includes a second color or pattern. Thus, a wearer can change the appearance of a customizable tie 100 including the reversible blade portion 220 by simply flipping the reversible blade portion 220 to expose the opposite side.

FIG. 5 is another embodiment of a knot portion 302 for the customizable necktie 100. The knot portion 302 includes a neck portion that is configured as a continuous band 307. In some embodiments, the continuous band 307 is elastic such that it can be stretched to slip over a wearer's head and then tighten in place around a wearer's neck. In some embodiments, the continuous band includes an elastic portion 309 that allows the knot portion 302 to be stretched to slip over a wearer's head and then tighten in place around a wearer's neck.

FIGS. 6A and 6B are front and back views an embodiment of a clip-on knot portion 402 for the customizable necktie 100. The clip-on knot portion 402 includes a knot 402 and attachment mechanism 406 similar to those described above. As shown in the back view of FIG. 6B, the clip-on knot portion 402 includes a clip 436. The clip 436 can extend from the back side 434 of the knot 404. The clip 436 can be used to clip the knot portion 402 to a user's collar to secure the knot portion 402 instead of the straps or continuous band previously described.

Although the preceding description has focused on customizable neckties, a person of ordinary skill in the art will appreciate that the principles disclosed herein are applicable to other types of neckwear. For example, FIGS. 7A and 7B illustrate a customizable bowtie 500.

Figure 7A:
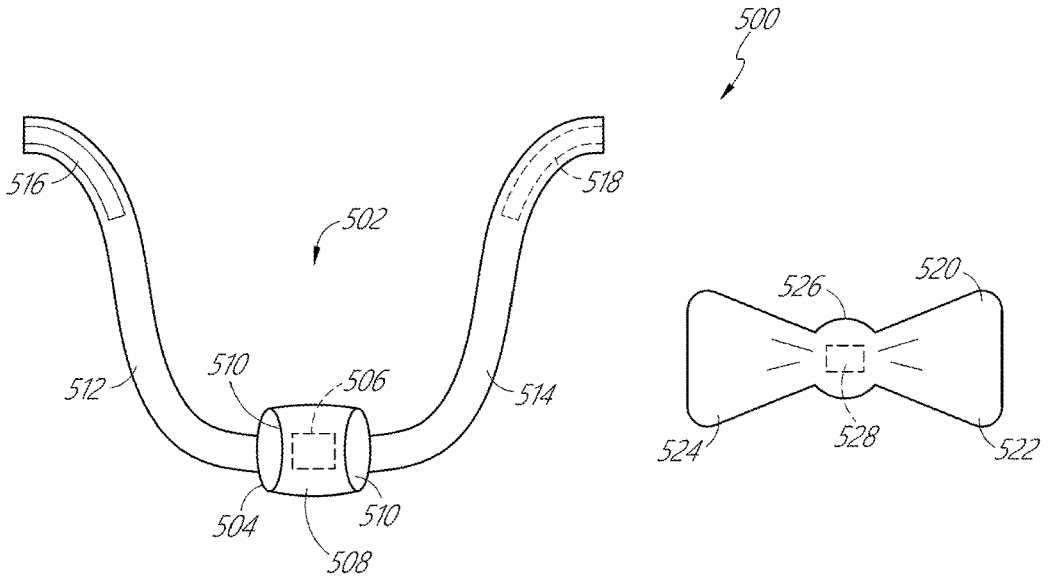
FIG. 7A illustrates a knot portion and a wing portion of an embodiment of a customizable bowtie in an unattached configuration.
Figure 7B:
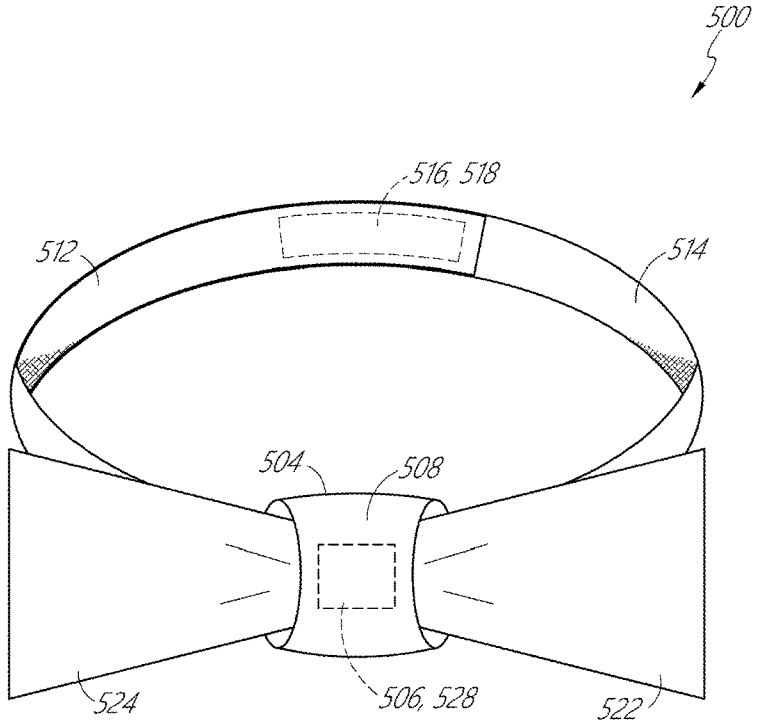
FIG. 7B illustrates the knot portion and the wing portion of the customizable bowtie of FIG. 7A in an attached configuration.

FIG. 7A illustrates a knot portion 502 and a wing portion 520 of an embodiment of a customizable bowtie 500 in an unattached configuration. FIG. 7B illustrates the knot portion 502 and the wing portion 520 of the customizable bowtie 500 in an attached configuration. The knot portion 502 includes a knot 504 that can be a fabricated or preformed knot. The knot 504 includes a front loop 508. An attachment mechanism 508 is positioned below the front loop 508 and is accessible via openings 510 on both sides of the knot 504. First and second straps 512, 514, including attachment mechanisms 516, 518 extend from the knot 504 and are configured to allow the knot portion 502 to be attached around a wearer's neck.

The wing portion 502 includes a first wing 522 and a second wing 524 connected by a central portion 526. An attachment mechanism 528 is included on the central portion 526. As shown in FIG. 7B, in the attached configuration, the wing portion 520 is pulled under the front loop 508 such that attachment mechanism 528 releasably attaches to the attachment mechanism 506 and the first and second wings 522, 524 extend out the openings 510. A plurality of wing portions 520 in different colors, patterns, shapes, and sizes can be provided such that a wearer can customize the appearance of the bowtie 500.

In some embodiments, the customizable neckties described herein are configured to be worn with a collared shirt; however, this need not be the case in all embodiments. For example, a customizable necktie can be worn with a collarless shirt or no shirt at all.

A kit for a customizable necktie can include one or more knot portions packaged together with one or more blade portions. Any of the one or more blade portions can be releasably attached to any of the one or more knot portions to create a customizable necktie. A user may vary the appearance and style of the customizable necktie by mixing and matching knot portions and blade portions.

Although described above with reference to being worn by a person, this disclosure is not limited thereto. For example, a customizable necktie as described herein can be configured for use by animals. As such, a knot portion of a customizable necktie can be configured to attach at or around a neck of an animal.

The foregoing description details certain embodiments of the systems, devices, and methods disclosed herein. It will be appreciated, however, that no matter how detailed the foregoing appears in text, the systems, devices, and methods can be practiced in many ways. As is also stated above, it should be noted that the use of particular terminology when describing certain features or aspects of the disclosure should not be taken to imply that the terminology is being re-defined herein to be restricted to including any specific characteristics of the features or aspects of the technology with which that terminology is associated.

It will be appreciated by those skilled in the art that various modifications and changes can be made without departing from the scope of the described technology. Such modifications and changes are intended to fall within the scope of the embodiments. It will also be appreciated by those of skill in the art that parts included in one embodiment are interchangeable with other embodiments; one or more parts from a depicted embodiment can be included with other depicted embodiments in any combination. For example, any of the various components described herein and/or depicted in the Figures can be combined, interchanged or excluded from other embodiments.

With respect to the use of substantially any plural and/or singular terms herein, those having skill in the art can translate from the plural to the singular and/or from the singular to the plural as is appropriate to the context and/or application. The various singular/plural permutations can be expressly set forth herein for sake of clarity.

It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims can contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The term "comprising" as used herein is synonymous with "including," "containing," or "characterized by," and is inclusive or open-ended and does not exclude additional, unrecited elements or method steps.

The above description discloses several methods and materials of the present invention. This invention is susceptible to modifications in the methods and materials, as well as alterations in the fabrication methods and equipment. Such modifications will become apparent to those skilled in the art from a consideration of this disclosure or practice of the invention disclosed herein. Consequently, it is not intended that this invention be limited to the specific embodiments disclosed herein, but that it cover all modifications and alternatives coming within the true scope and spirit of the invention as embodied in the attached claims.

What is claimed is:

1. A necktie consisting of:

a knot portion configured to be secured around a neck of a wearer, the knot portion consisting of:

a simulated knot having a front loop configured as a strip of material that extends transversely across the simulated knot, wherein the front loop wraps over an inner surface of the knot and an opening is formed between the front loop and the inner surface, a first attachment mechanism consisting of two eyes positioned on the inner surface of the simulated knot and covered by the front loop, wherein the first attachment mechanism is accessible through the opening, and wherein the two eyes are spaced apart, and a neck portion extending from the simulated knot, the neck portion consisting of:

a first strap extending from a first side of the simulated knot and a first fastener positioned on a distal end of the first strap;

a second strap extending from a second side of the simulated knot and second fastener positioned on a distal end of the second strap, wherein the first fastener is configured to releasably attach to the second fastener to secure the knot portion around the neck; and a blade portion consisting of a front blade, a rear blade, and a second attachment mechanism configured to releasably attach to the first attachment mechanism, wherein the second attachment mechanism is positioned on the blade portion proximal to a top end of the blade portion, and wherein the second attachment mechanism consists of two hooks configured to attached to the two eyes of the first attachment mechanism of the knot portion such that, when attached the blade portion hangs from the knot portion.

2. The necktie of claim 1, wherein the first and second fasteners consist of hook and loop material.

3. The necktie of claim 1, wherein the first and second fasteners consist of snaps.

4. The necktie of claim 1, wherein the first and second fasteners consist of a magnetic closure mechanism.

5. The necktie of claim 1, wherein the simulated knot is configured to be one of a Windsor knot, a half-Windsor knot, a four-in-hand knot, and a Pratt knot.

6. A necktie consisting of:

a knot portion configured to be secured around a neck of a wearer, the knot portion consisting of:

a simulated knot having a front loop configured as a strip of material that extends transversely across the simulated knot, wherein the front loop wraps over an inner surface of the knot and an opening is formed between the front loop and the inner surface, a first attachment mechanism consisting of two hooks positioned on the inner surface of the simulated knot and covered by the front loop, wherein the first attachment mechanism is accessible through the opening, and wherein the two hooks are spaced apart, and a neck portion extending from the simulated knot, the neck portion consisting of:

a first strap extending from a first side of the simulated knot and a first fastener positioned on a distal end of the first strap;

a second strap extending from a second side of the simulated knot and second fastener positioned on a distal end of the second strap, wherein the first fastener is configured to releasably attach to the second fastener to secure the knot portion around the neck; and a blade portion consisting of a front blade, a rear blade, and a second attachment mechanism configured to releasably attach to the first attachment mechanism, wherein the second attachment mechanism is positioned on the blade portion proximal to a top end of the blade portion, and wherein the second attachment mechanism consists of two eyes configured to attached to the two hooks of the first attachment mechanism of the knot portion such that, when attached the blade portion hangs from the knot portion.

7. The necktie of claim 6, wherein the simulated knot is configured to be one of a Windsor knot, a half-Windsor knot, a four-in-hand knot, and a Pratt knot.

8. The necktie of claim 6, wherein the first and second fasteners consist of hook and loop material.

9. The necktie of claim 6, wherein the first and second fasteners consist of snaps.

10. The necktie of claim 6, wherein the first and second fasteners consist of a magnetic closure system.

* * * * *